US005950829A

United States Patent [19]

Gale

[11] Patent Number: 5,950,829

[45] Date of Patent: Sep. 14, 1999

[54] PACKAGING INCLUDING A SHELL FOR BOTTLES

[76] Inventor: Gregory W. Gale, 3380 Atlas Peak Rd., Napa, Calif. 94558

[21] Appl. No.: 09/079,050

[22] Filed: May 14, 1998

[51] Int. Cl.[6] ..... B65D 81/00

[52] U.S. Cl. ..... 206/433; 220/516

[58] Field of Search ..... 206/427, 433, 206/564, 419; 229/406, 407; 220/509, 513, 516

[56] References Cited

U.S. PATENT DOCUMENTS

| | | | |
|---|---|---|---|
| 4,427,730 | 1/1984 | Robbins et al. | 206/419 X |
| 4,840,276 | 6/1989 | George | 206/564 X |
| 5,127,526 | 7/1992 | Vigue | 206/419 X |
| 5,335,770 | 8/1994 | Baker et al. | 206/433 |
| 5,816,409 | 10/1998 | Baker et al. | 206/433 |

*Primary Examiner*—Jacob K. Ackun
*Attorney, Agent, or Firm*—Harold C. Hohbach; Flehr Hohbach Test Albritton & Herbert

[57] ABSTRACT

Packaging for at least one bottle having a cylindrical base portion and a narrowed neck portion comprising a shell formed of a nonplastic material. The shell is formed of first and second parts. The first and second parts each have a bottle receiving recess formed therein. The bottle receiving recesses have first and second portions. The first portion is formed to receive the cylindrical base portion of the bottle and the second portion is formed to receive the neck portion of the bottle. The first and second parts are movable with respect to each other to each enclose a portion of a bottle disposed in the shell. A case encloses the shell.

22 Claims, 8 Drawing Sheets

PACKAGING INCLUDING A SHELL FOR BOTTLES

This invention relates to packaging including a shell for bottles and more particularly to packaging including a wine shell for various types of wine bottles.

As is well known, many types of liquids and even powders are shipped and stored in glass containers or bottles and particularly wine bottles. Packaging for such bottles and in particular of wine bottles provides protection during shipping of the bottles to prevent breakage of the bottles and also to prevent the bottles from scuffing each other during shipment and particularly to prevent scuffing of any paper labels carried by the bottles. Such packaging typically has utilized cardboard and for dividers within the cartons. For environmental reasons and for cost savings, it is desirable to minimize or possibly even eliminate the use of cardboard for dividers in such packaging. There is therefore a need for a new and improved packaging for bottles which overcomes the above-identified disadvantages.

In general, it is an object of the present invention to provide packaging including a shell for bottles and a carton or case enclosing the same which can be utilized in corrugated boxes for shipping and storage of the bottles before and after they are filled.

Another object of the invention is to provide a shell which eliminates scuffing of paper labels on the bottles encased therein.

Another object of the invention is to provide packaging and a shell of the above character in which the shell can take the form of one folded piece which is utilized for holding two-bottles to provide a two bottle pack shell.

Another object of the invention is to provide packaging in which the shells can be stacked within the carton or case.

Another object of the invention is to provide packaging of the above character in which the shells can be stacked to provide packaging for four bottles.

Another object of the invention is to provide packaging of the above character in which shells can be stacked to provide packaging for six bottles.

Another object of the invention is to provide packaging of the above character in which the shells can be stacked three deep for bottles to provide packaging for twelve bottles.

Another object of the invention is to provide packaging of the above character in which the shell is formed of molded fiber.

Another object of the invention is to provide packaging and a shell therefor which can be utilized in automatic packaging machinery.

Another object of the invention is to provide packaging and a shell therefor which makes it possible to accommodate various types of bottles.

Another object of the invention is to provide packaging and a shell therefor in which various types of wine bottles can be accommodated.

Another object of the invention is to provide packaging and a shell therefor which is economical to produce and which is environmentally desirable.

Additional objects and features of the invention will appear from the following description in which the preferred embodiments are set forth in detail in conjunction with the accompanying drawings.

Figure 1:
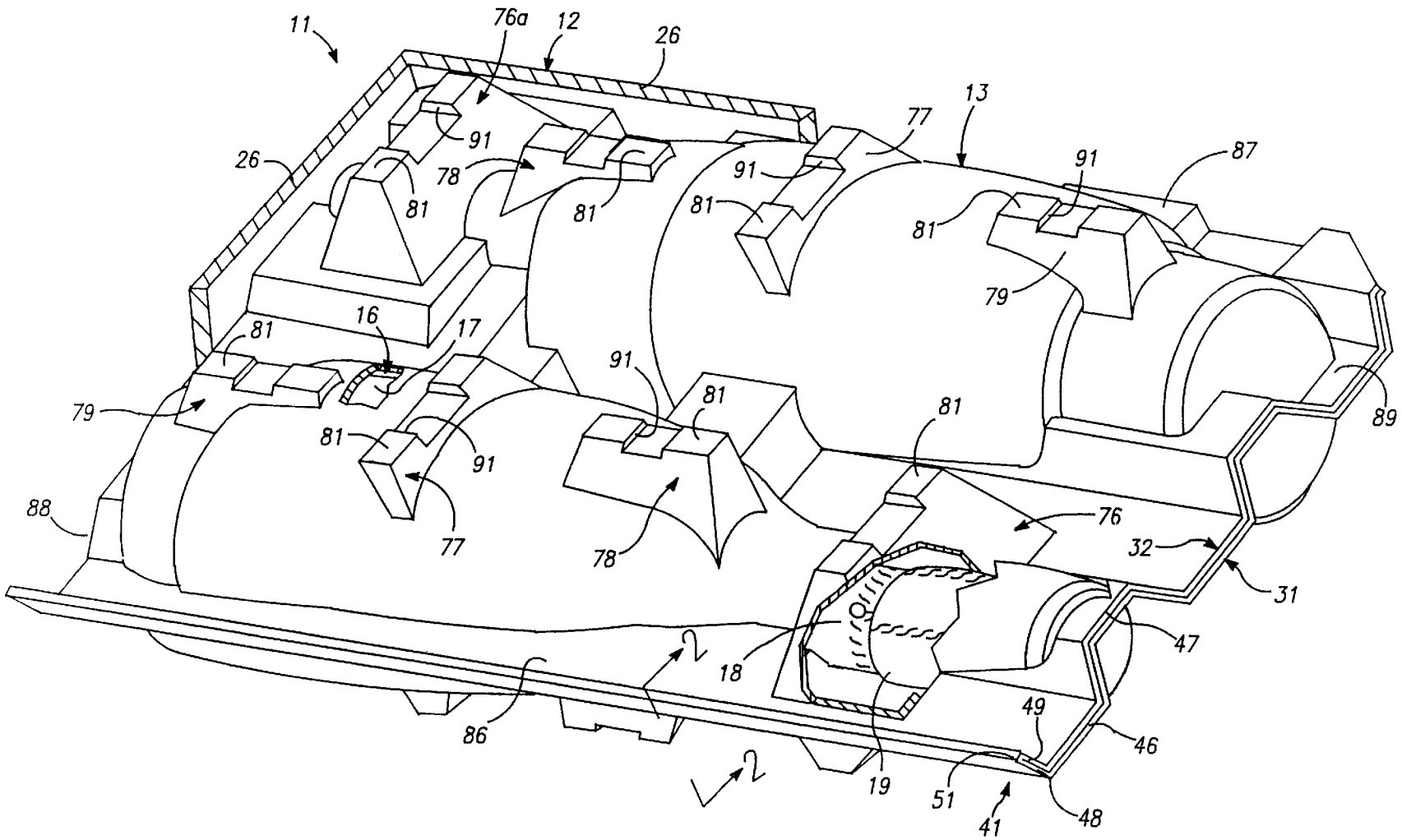
FIG. 1 is an isometric view of packaging including a shell for bottles incorporating the present invention.

In general the present invention consists of packaging for a plurality of bottles having a cylindrical base portion and a narrowed neck portion and comprises a first shell formed of a nonplastic material. The shell is formed of first and second parts with the second part being movable to a superposed position overlying the first part in which each of the first and second parts has first and second juxtaposed bottle receiving recesses formed therein extending in parallel directions. Each of the first and second bottle receiving recesses has first and second portions with the first portion being formed to receive the cylindrical base portion of the bottle and the second portion being formed to receive the neck portion of the bottle. A case encloses the shell to provide the packaging for the bottles.

More in particular, as shown in FIGS. 1 through 4, the packaging 11 incorporating the present invention is a case or carton 12 which encloses a shell or a carrier 13. The shell or carrier 13 contains therein at least one bottle and preferably a plurality of bottles as for example two bottles as shown. The bottles 16 are of a conventional type utilized for liquids, powders and the like. For example of particular interest in the present invention is the packaging for wine bottles of different types. The bottles can be characterized as having a cylindrical base or bottle portion 17 and a neck portion 18 which is provided with a conventional closure 19 in the form of a cork or a cap. The bottle 16 has a cylindrical portion between the base portion and the narrowed neck portion that typically carries a paper label which is subject to scuffing.

The case or carton 12 can be a conventional cardboard container having corrugated side walls and end flaps 26 in which the end flaps are closed and then secured in a conventional manner as for example by the use of an adhesive.

The shell or carrier 13 is formed of a nonplastic material and preferably in accordance with the present invention is formed of a molded pulp. The pulp can be from reclaimed paper products such as newspapers and corrugated cardboard for the raw material.

The shell 13 is formed of first and second parts 31 and 32. The second part 32 is movable so that it is superposed over the first part 31. Each of the first and second parts 31 and 32 has at least one bottle receiving recess and preferably as shown has first and second juxtaposed bottle receiving recesses or cells 36 and 37 with the recesses or cells 36 and 37 extending generally in parallel directions. Each of the bottle receiving recesses or cells 36 and 37 is formed with first and second portions 38 and 39 with the first or base portion 38 being formed to receive the cylindrical base of the bottle and the second or neck support portion 39 being formed to receive the neck of the bottle.

As shown particularly in FIG. 3, the recesses 36 and 37 are formed so that each of the two bottles in the juxtaposed recesses face in opposite directions or are disposed in directions 180° offset with respect to each other to make it possible to provide additional strength to the shell. The first or base portion 38 is provided in each of the bottle receiving recesses 36 and 37 to provide support for a bottle which is disposed therein. Thus the first or base portion 38 is provided with a middle sub-support portion 38*a* which has a larger semi-cylindrical diameter which is intermediate sub-support portions 38*b* and 38*c* in which the sub-support portion 38*b* is semi-cylindrical but has a diameter which is less than that of the sub-support portion 38*a*. The end sub-support portion 38*c* is also semi-cylindrical and has a diameter slightly less than that of the sub-support portion 38*a* but has a rounded conformation to provide a transition from the base portion 17 of the bottle 16 to the smaller diameter neck portion 18. The end sub-support portion 38*c* is provided with a tapered wall leading to a smaller diameter to its extreme end. Bottles 16 have been provided in the bottle receiving recesses 36 and 37.

The second or neck support portion 39 is similarly provided with an intermediate neck support portion 39*a* and an end of neck or cap support portion 39*b*.

Although the first and second parts 31 and 32 can be formed of separate and independent parts in accordance with the present invention, yet however it is desirable that the first and second parts 31 and 32 be interconnected by a hinged construction 41. This hinged construction makes it possible to swing one part over the other part as for example the second part 32 over the first part 31.

The first and second parts 31 and 32 of the shell 13 are formed of the molded pulp hereinbefore described to provide a molded pulp wall defining the bottle receiving recesses or cells 36 and 37 having a thickness ranging from 0.005" to 0.100" and preferably approximately 0.0625". By comparing FIGS. 1 and 3A and 3B it can be seen that the inner surfaces of the molded pulp material forming the bottle receiving recesses or cells 36 and 37 have outer surfaces which are generally complementary thereto. Thus, the first part 31 and the second part 32 are formed in a mold by forming a single sheet of material 43 over molds (not shown) by a conventional method using pulp fibers mixed into a liquid such as water in which the first and second parts 31 and 32 are adjoined by a hinged construction 41 which consists of upstanding longitudinally extending edges 48 and 49 provided on each of the parts (see FIG. 1) which are foldable along a hinge line 51 also extending longitudinally of the edges 48 and 49 so that they are juxtaposed one over the other. As can be seen, the upstanding edges 48 and 49 are disposed on one side of each of the parts 31 and 32 and on one side of the one of the two bottle receiving recesses 36 and 37 and more particularly are disposed adjacent to and parallel to the bottle receiving recesses 36.

Crenelated structures 61 are provided in the first and second parts 31 and 32 and lie on the other sides of the bottle receiving recess 36 and between the bottle receiving recesses 36 and 37 and also on the other side of the bottle receiving recesses 37. The crenelated structures 61 are formed by providing in the first part 31 a first set of planar mating surfaces 62 lying in one plane and a second set of planar mating surfaces 63 lying in a second plane spaced apart from the first plane with the second plane being disposed above the first plane and with sloping side walls 64 adjoining the surfaces 62 and 63.

In a similar manner, the second part is provided with a first set of planar mating surfaces 66 lying in a first plane and a second set of planar mating surfaces 67 lying in a second plane spaced from the first plane and with the second plane lying above the first plane with sloping side walls 68 adjoining the surfaces 66 and 67. From this construction it can be seen that the surfaces 66 of the second part are complementary to and will mate with the first set of mating surfaces 62 and similarly, the second set of mating surfaces 67 of the second part will mate with the second set of planar mating surfaces 63 of the first part. The first and second parts 31 and 32 thereby intermesh to form a complementary structure in which the second part reinforces the first part and similarly the first part reinforces the second part when the second part has been swung into position over the first part 31. The shell 13 is thereby formed about the bottles that are disposed within the bottle receiving recesses 36 and 37 with the base and neck portions 17 and 18 of the bottles being firmly engaged by the shell.

In order to facilitate placing of the shell 13 in a substantially conventional case or carton 12 typically is in the form of a parallelepiped, support structures are provided on the exterior surfaces of the shell 13 that are adapted to engage the side walls of the case or carton 12 and are in registration with the recesses 36 and 37. Thus overlying and underlying each of the bottle receiving recesses 36 and 37 there are provided first and second spaced apart transversely extending supports 76 and 77 and first and second longitudinally extending and longitudinally extending supports 78 and 79. The supports 76 differ from each other for the two recesses 36 and 37 as hereinafter described and thus the support 76 for recess 37 is identified as part 76*a*. As can be seen from FIG. 1, the first transversely extending support 76 extends across the neck portion 39 of the bottle receiving recess and the second transversely extending support 77 extends across the midsection of the first or base portion of the bottle receiving recess. The first longitudinally extending support 78 is disposed approximately midway between the support 76 and 77 and overlies the transition of the recess between the base portion and the neck portion of the recess. The second longitudinally extending support 79 overlies and underlies the base portion of the bottle receiving recess and is spaced from the second transversely extending support 77. As can be seen, the supports 76, 77, 78 and 79 are of various dimensions conforming to the curvatures of the shell 13 and are of various heights ending in truncated pyramidal structures which have planar surfaces 81 lying in a common plane lying on each side of the first and second parts 31 and 32. If desired as shown notches 91 are provided in the surfaces 81 to aid in distributing the forces engaging the surfaces 81. These surfaces 81 face a side wall of the carton or case 12 and are adapted to engage the side wall of the carton or case to firmly support the shell 13 within the carton after the carton or case has been closed. The length and width of the case or carton 12 is chosen so that the side margins 85 and 87 engage the other side walls of the case or carton perpendicular to the side walls engaged by the surfaces 81 and with the end margins 88 and 89 of the shell 13 engaging the top and bottom ends of the case or carton 12.

The supports 76, 77, 78 and 79 can be formed from the same sheet of molded pulp fiber and have substantially uniform thickness therethrough. This is accomplished by providing within the first and second parts 31 and 32, bottle receiving recesses 36 and 37 and inverted truncated pyramidal recesses 96, 97 and 98 within the recesses 36 and 37. The recesses 96 for the two recesses 36 and 37 differ from each other and thus the recess 96 for recess 37 is designated as recess 96*a*. The first transversely extending support 76 for the bottle receiving recess 36 is of greater height than the first transversely extending support 76*a* provided for the second bottle receiving recess because it emanates from a higher plane than the first transversely extending support 76. Therefore the recess 96*a* corresponding to the support 76*a* is deeper than the recess 96. Thus the recesses 96 and 96*a* are complementary to the supports 76 and 76*a*. The recesses 97 are complementary to the supports 77. Similarly the recesses 98 and 99 are complementary to the first and second longitudinally extending supports 78 and 79.

Figure 2:
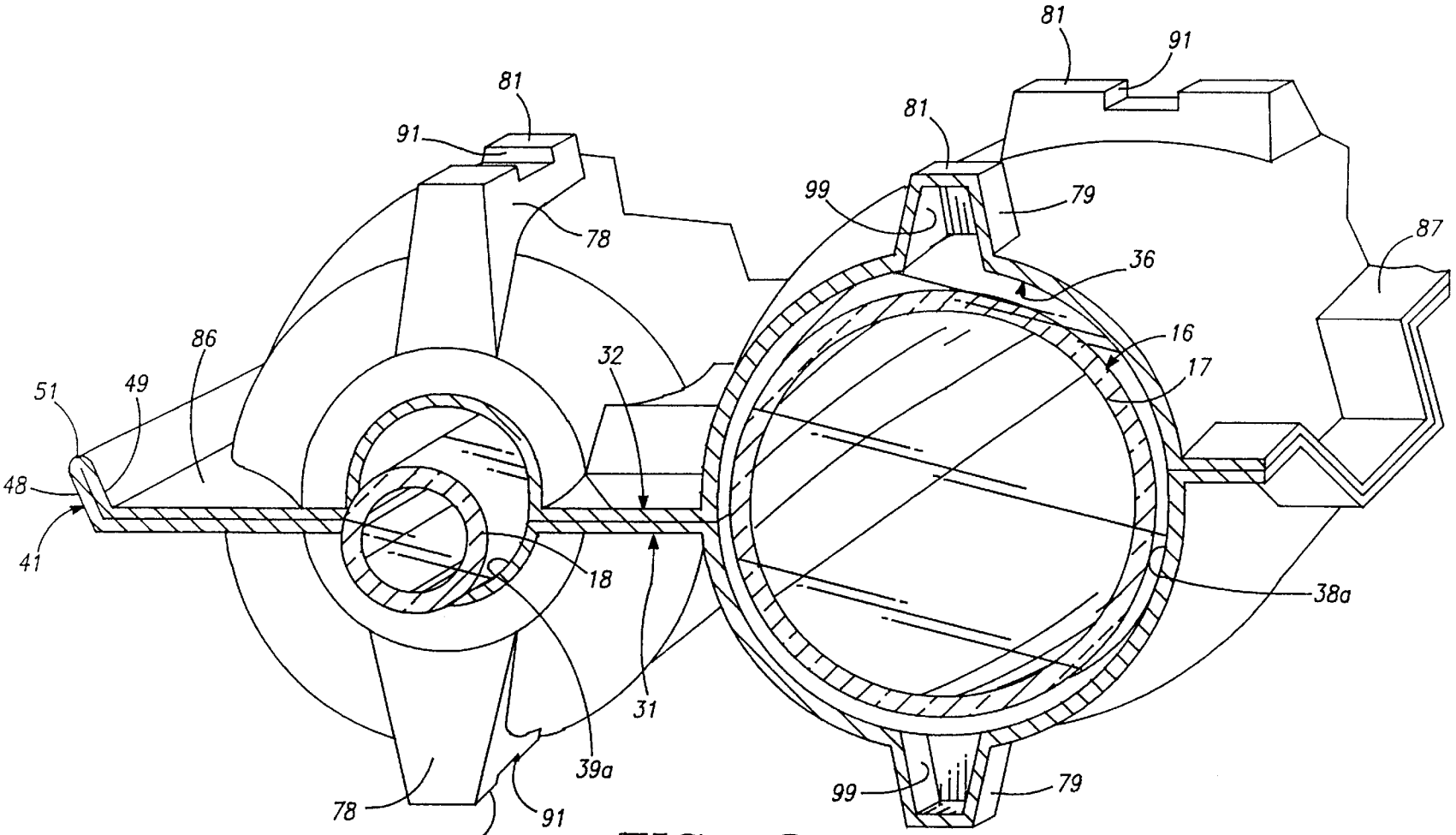
FIG. 2 is another isometric view of the shell shown in FIG. 1 in cross section along the line 2—2 of FIG. 1.
Figure 3A:
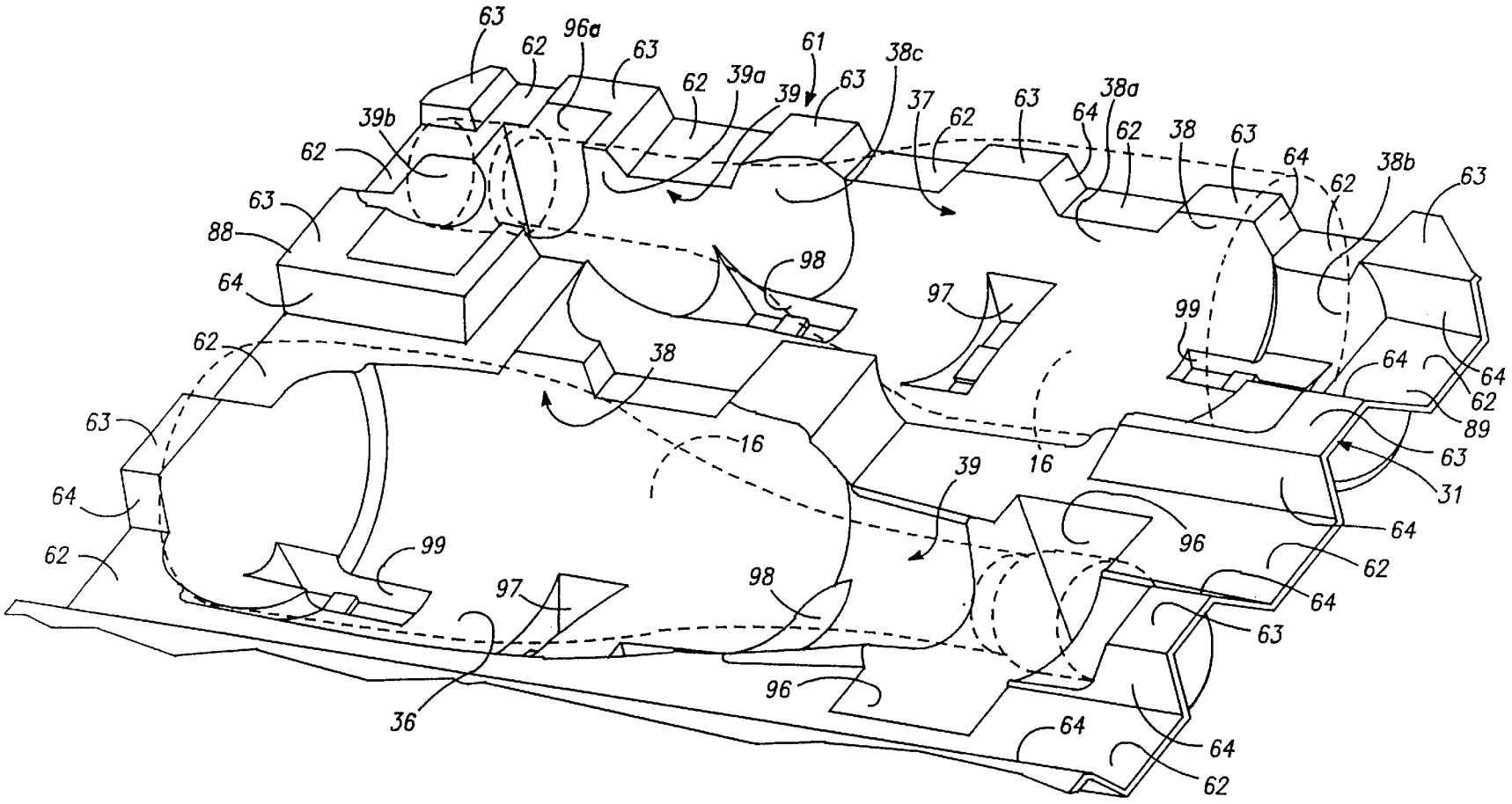
FIGS. 3A and 3B are isometric views of the shell shown in FIGS. 1 and 2 in an open position with champagne bottles disposed in one side of the shell being shown in dotted lines.
Figure 3B:
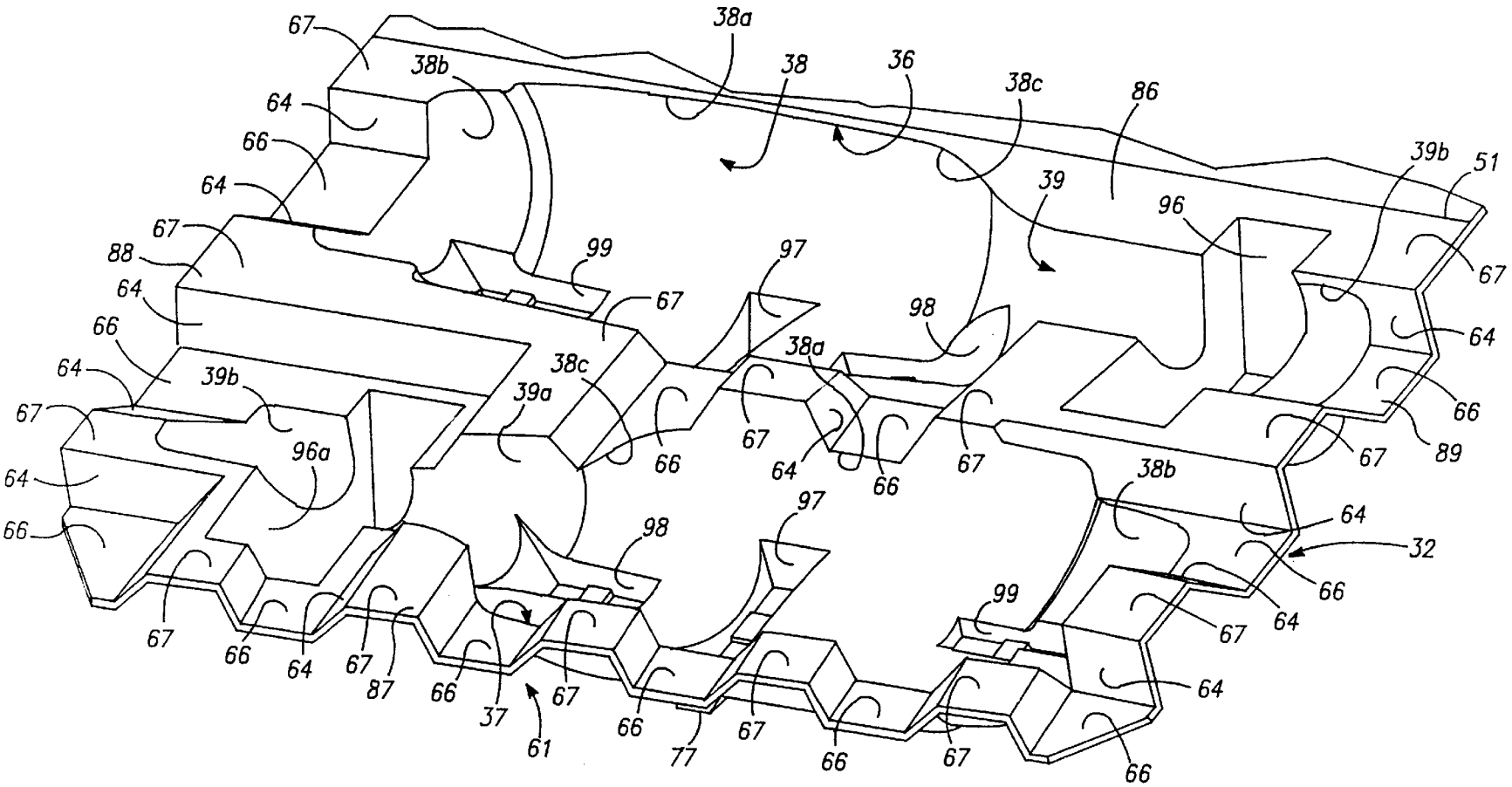

Use of the shell or carrier 13 in the case or carton 12 for forming packaging 11 for bottles may now be briefly described as follows. Let it be assumed that it is desired to place bottles as for example champagne bottles 16 as shown in FIGS. 1 through 3 within the shell or carrier 13 lying flat as shown in FIG. 3. Let it also be assumed that the shell 13 has been separated from a stack of such shells supplied from a molding operation. It can be placed on a conveyor and champagne bottles 16 loaded into the bottle receiving recesses 36 and 37 either by hand or automatically by machine with the two bottles facing in opposite directions to fit the conformations of the bottle receiving recesses 36 and 37. Thus, the base 17 of the champagne bottle 16 rests in the middle of sub-support portion 38*a* of the recess and engages a wall provided by the sheet 43 so that it is supported above the end sub-support portion 38*b* and with the neck portion 18 resting upon the intermediate neck support portion 39*a* and with the end of the neck with the champagne cap thereon being disposed within the sub-support portion 39*b*.

As soon as both of the champagne bottles 16 have been placed in the recesses or cells 36 and 37, the second part 32 can either be manually or automatically swung over the top of the first part 31 causing folding along the hinge line 51 of the hinged construction 41 between the first and second parts 31 and 32 so that the bottle receiving recesses 36 and 37 receive the two underlying champagne bottles 16 and engage the same to firmly encase the champagne bottles 16 within the shell.

As soon as the encased champagne bottles have been moved down a conveyor or positioned manually, they can be packaged in a case or carton 12 either manually or by automatic packaging machinery by rotating the shell encased champagne bottles 16 into a vertical position and then lowering the same into the case or carton 12 after which the top flaps of the case or carton 12 can be sealed in a conventional manner such as by the use of an adhesive to complete the packaging 11 for the champagne bottles. Prior to encasement, the champagne bottles typically would be appropriately labeled and after being encased in the packages hereinbefore described. The case or carton carrying the champagne bottles also can be labeled in an appropriate manner.

The packaging 11 heretofore provided has numerous advantages. First it utilizes materials which are environmentally desirable, i.e. the use of a molded pulp shell which typically is made from recycled materials as hereinbefore described. In addition, the wine bottles are firmly ensconced within the shell and are prevented from coming in contact with each other to prevent marring of the glass and/or of the labels carried by the glass bottles. In addition because of the construction of the shell, the champagne bottles are well protected from shock forces by the molded pulp shell. In addition, the structural features of the molded pulp shell provide very substantial shock absorbing capabilities. Such shock absorbing capabilities are provided by the collapsible support structures provided on opposite sides of the shell and also by the collapsible side and end margins of the shell, permitting the package to absorb substantial shocks without danger of breakage of the bottles carried therein.

It should be appreciated that although the shell 13 has been described as having hinged construction 41 between the first and second parts 31 and 32, the present invention can still be practiced by having the first and second parts be separate parts with no hinged relationship.

Figure 4:
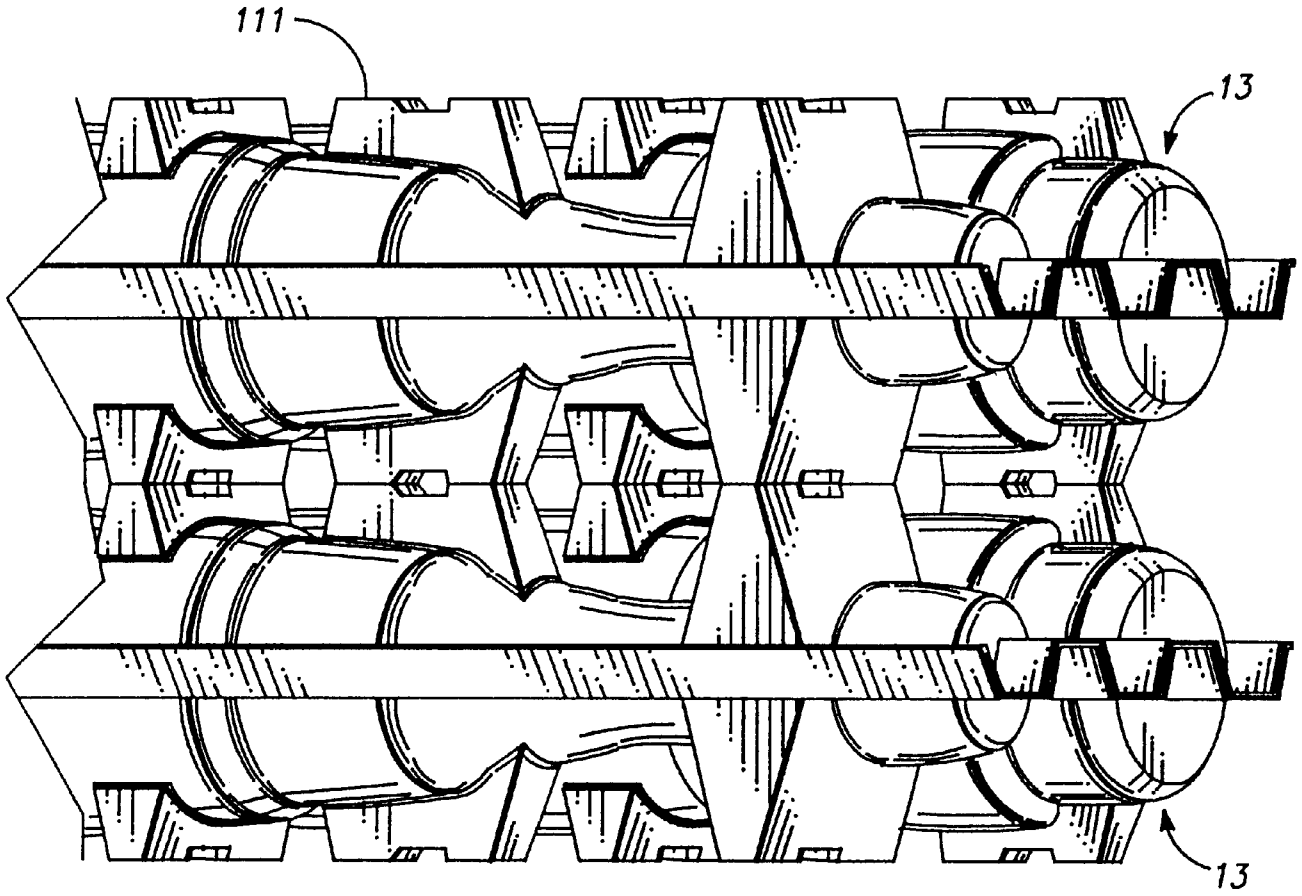
FIG. 4 is an isometric view partially in cross section showing two stacked two-bottle shells enclosed within a carton or case.
Figure 5:
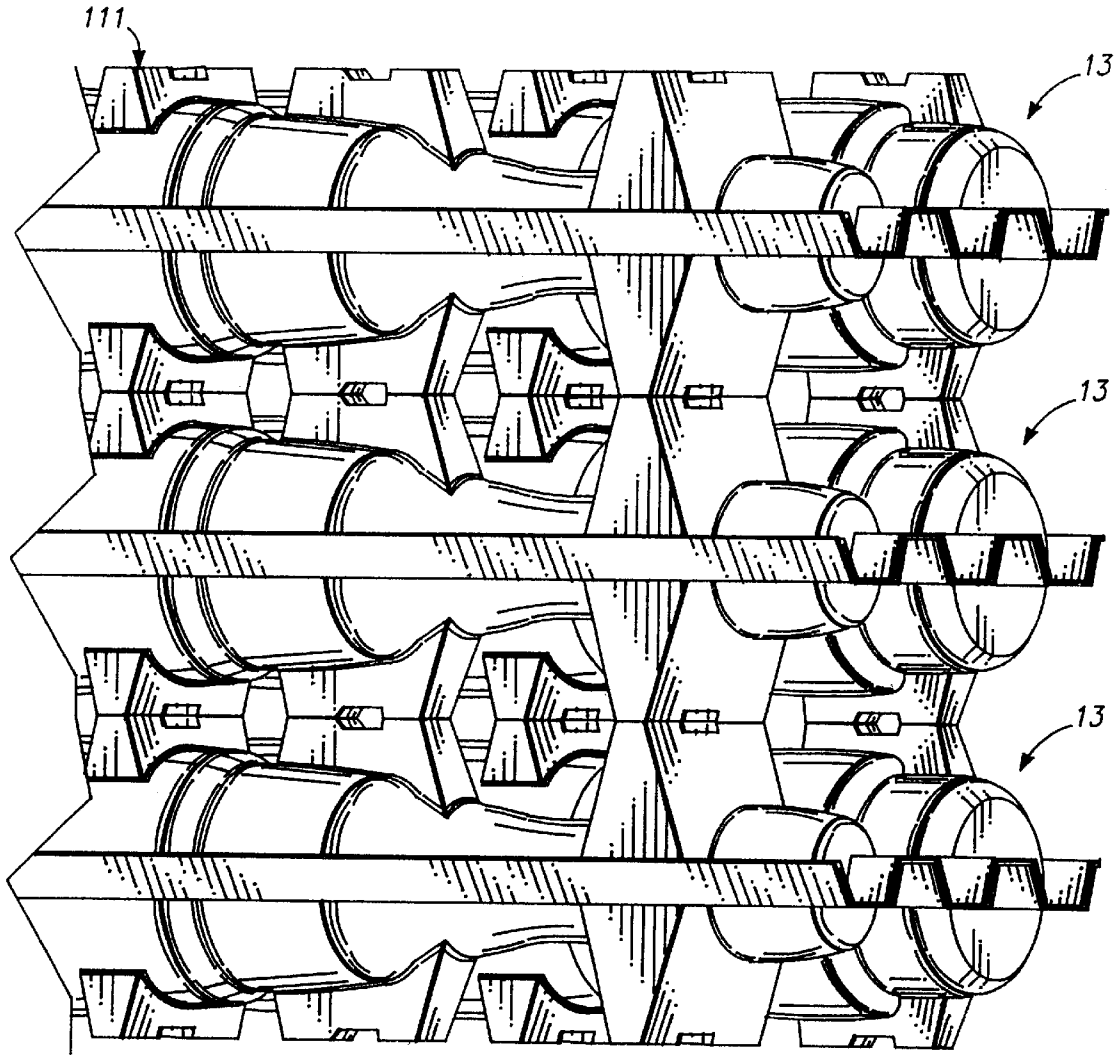
FIG. 5 is an isometric view partially in cross section showing three stacked two-bottle shells enclosed within a carton or case.

In addition it should be appreciated that the shell or carrier 13 can be stacked in such a manner so as to provide packaging for four bottles, six bottles and twelve bottles with relative ease. For example there is shown in FIG. 4, packaging 111 in which two of the shells 13 with bottles therein are stacked side by side or on top of each other and then enclosed within a larger case or carton 112 to complete the packaging 111. Similarly as shown in FIG. 5, six bottles have been provided in which three of the shells 13 encasing bottles can be stacked side by side in a triple stack or stacked one above the other and then enclosed in a still larger case or carton 117 of a type hereinbefore described to complete the packaging 116.

Figure 6:
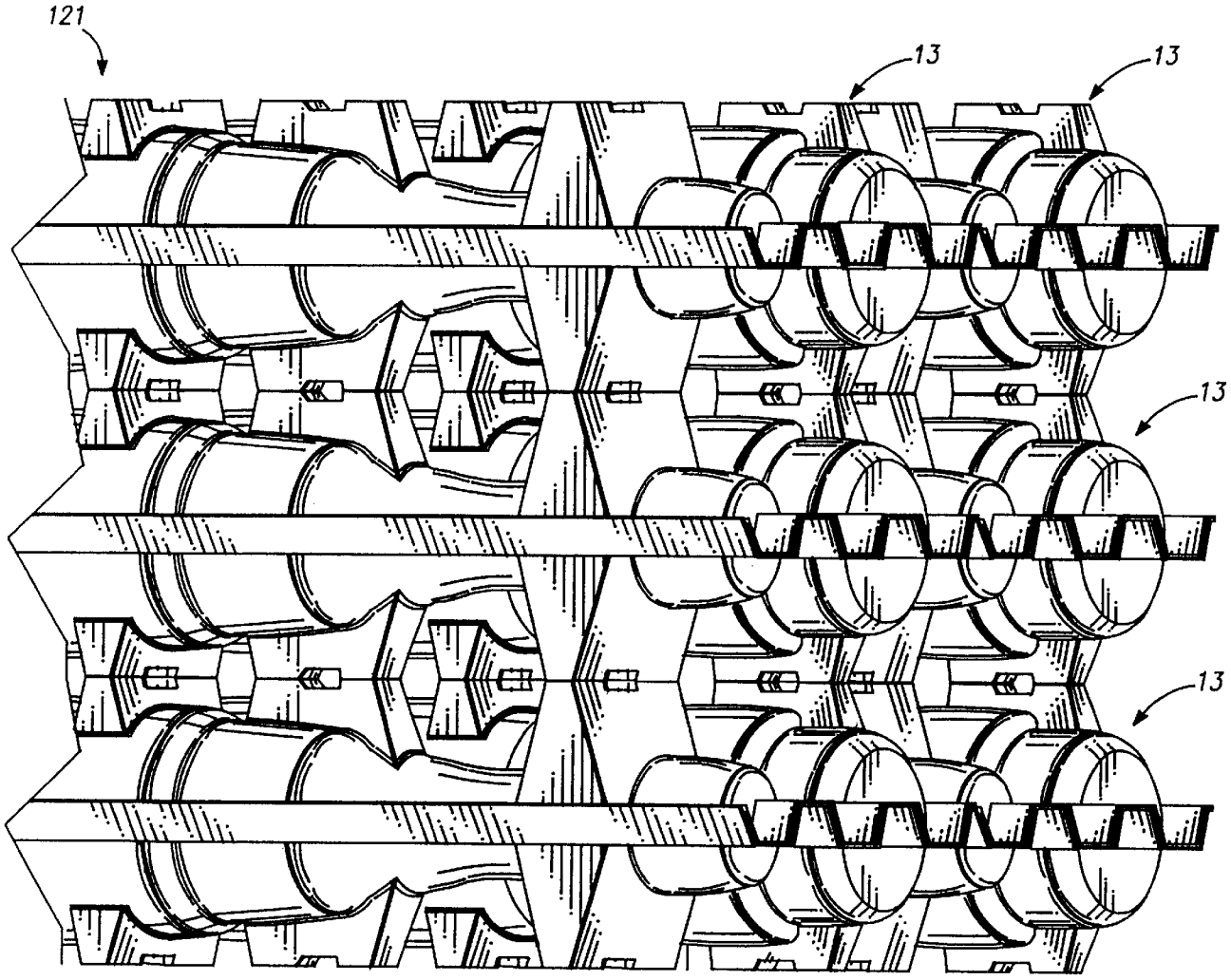
FIG. 6 is an isometric view partially in cross section showing six two-bottle shells stacked side by side in three layers enclosed in a carton or case to provide packaging for twelve bottles.

In a similar manner there is shown in FIG. 6 packaging 121 for twelve bottles using six two-bottle shells 13 encasing bottles by stacking two of the shells 13 side by side to provide a row of four bottles and then providing two additional sets of side by side stacked shells 13 to provide three layers or rows of four bottles each to provide the twelve bottles enclosed in the packaging 121. The six shells 13 are then encased in a still larger case or carton 122 similar to that hereinbefore described to complete the packaging 121.

Alternatively, to save the labor of folding the shells, the shells 13 can remain flat to provide recesses or cells 36 for four bottles 16 in three layers. The shells 13 without being folded can be stacked with one shell 13 on the bottom with four bottles 16 in the recesses 36 and covered by another shell 13 to provide one layer. The two other layers of four bottles each can be formed in a similar manner. This alternative arrangement uses the same number of shells and the same amount of space but decreases the amount of labor by eliminating folding of the shells.

Figure 7:
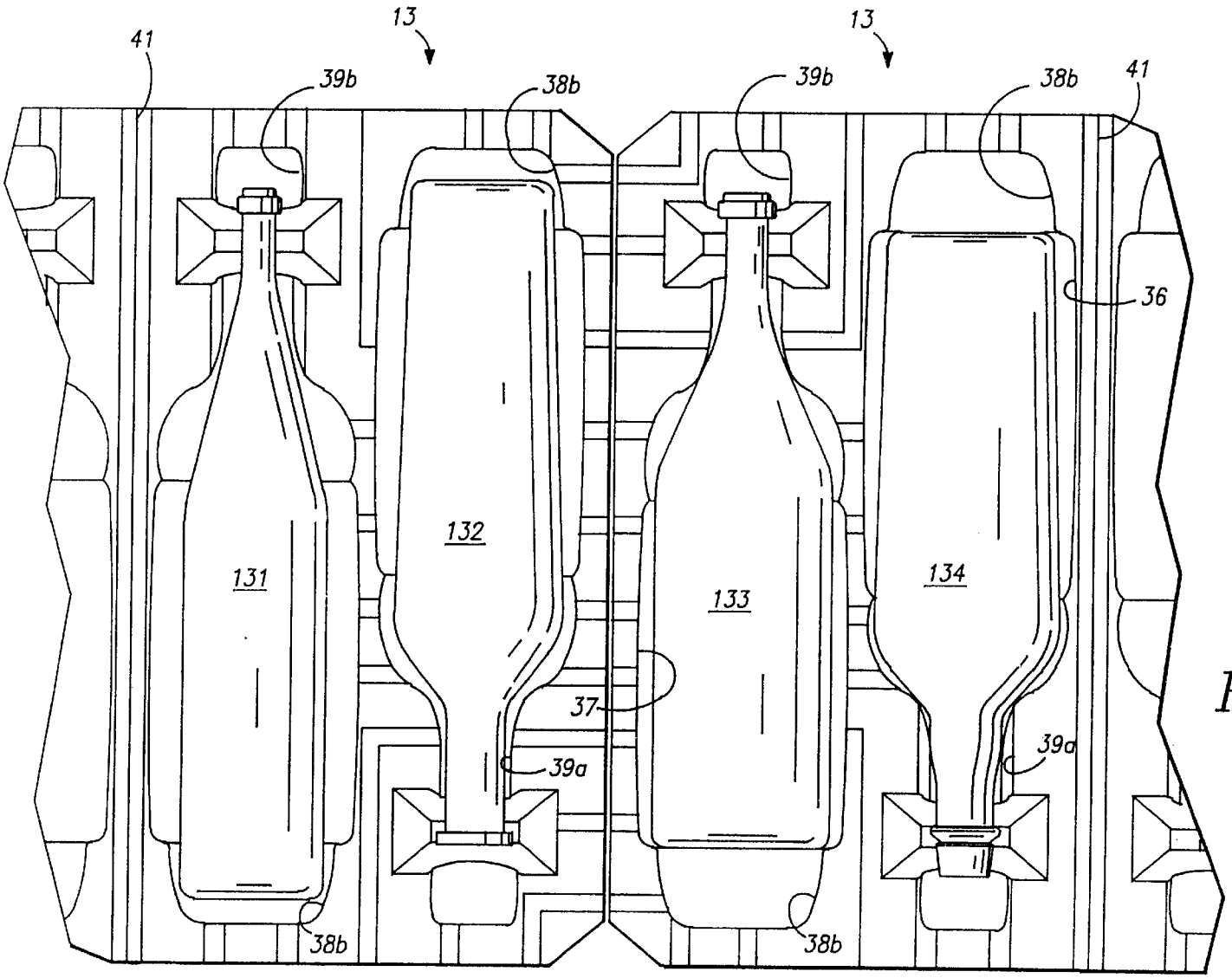
FIG. 7 is a top plan view showing the manner in which other types of bottles as for example other types of wine bottles can be packaged in the packaging including a shell incorporating the present invention.

In FIG. 7, there are shown two shells 13 which are disposed side by side to provide packaging for four bottles 16. However, rather than showing champagne bottles as hereinbefore described in conjunction with FIGS. 1 through 3, different types of wine bottles are depicted showing the manner in which the different types of wine bottles can be accommodated within the same bottle receiving recesses or cells 36 and 37 hereinbefore described. Going from left to right as viewed in FIG. 7 there is shown a plurality of different types of wine bottles conventionally used in the wine industry for the bottling of wine. Thus the first bottle shown is a bottle 131 which has a conformation of a "hock" bottle which has its base portion disposed within the end sub-support portion 38*b* and with the end of its neck being disposed within the sub-support portion 39*b* to provide support for the opposite ends of the bottle 131. Next there is shown a bottle 132 which can be characterized as a "claret"

bottle in which the base portion is disposed within the sub-support portion 38*b* and its neck is supported in the sub-support portion 39*a*. Next there is shown another bottle 133 which can be described as a "burgundy" bottle which has its base resting immediately above the subsupport portion 38*b* and has its neck disposed in the neck sub-support portion 39*b*. And last there is shown another bottle 134 which can be characterized as a "port" bottle in which the base of the bottle is supported above the sub-support portion 38*b* and in which the neck of the bottle is supported in the sub-support portion 39*a*. Thus it can be seen from the examples given in addition to the champagne bottle as hereinbefore described in conjunction with FIGS. 1 through 3, four additional types of bottles can be readily accommodated by the shell 13 utilizing the conformation of the bottle receiving recesses 36 and 37 to provide adequate support for these different types of bottles without changing the conformation of the recesses 36 and 37. In this way, it can be seen that the shell 13 can be utilized for encasing of the common varieties of wine bottles presently in use by the wine industry. In FIG. 7, one of the principal features of the shell 13 of the present invention can be seen. As clearly depicted in that Figure as well as in preceding figures, the middle portion 38*c* has a larger diameter and is curved in such a manner so that a space appears between the bottles encased therein and the labels thereon to prevent contact of the labels with surfaces of the portion 38*a* to prevent scuffing or abrasion of the labels. Thus it can be seen that the packaging 11 of the present invention is very versatile in that it can accommodate many different types of bottles while providing adequate support for the same within the shell and the case or carton packaging the shell to provide the packaging of the present invention.

What is claimed:

1. Packaging for at least one bottle having a cylindrical base portion, a narrowed neck portion, and a cylindrical portion between the cylindrical base portion and the narrowed neck portion and carrying a label which is subject to scuffing, comprising a shell formed of a nonplastic material, said shell being formed of first and second parts, said first and second parts each having a bottle receiving recess formed therein, each of said bottle receiving recesses having first and second semi-cylindrical portions and an intermediate semi-cylindrical portion intermediate the first and second portions, said intermediate portion having a larger diameter than the diameters of the first and second portions, said first portion being formed to receive the cylindrical base portion of the bottle and the second portion being formed to receive the neck portion of the bottle, said first and second parts being movable with respect to each other to each enclose a bottle disposed in the shell and a case enclosing the shell, said intermediate semi-cylindrical portion being sized so that it has a diameter greater than the diameter of the cylindrical base portion of the bottle carrying the label whereby a space is provided between the at least one bottle and the shell to prevent contact of the label of the at least one bottle with the shell to thereby prevent scuffing of the label during movement of the packaging with the at least one bottle therein.

2. Packaging as in claim 1 wherein said first and second parts of said shell are formed of sheet material.

3. Packaging as in claim 2 further including a plurality of support members formed from the sheet material and into the shell in positions in registration with the recesses and engaging the side walls of the case.

4. Packaging as in claim 1 wherein said shell includes first and second opposed parallel side margins and first and second opposed end margins, said side margins and said end margins engaging respectively sides and ends of the case.

5. Packaging as in claim 3 wherein said first and second parts are formed of the same sheet of material and have a hinged construction extending therebetween permitting the first and second parts to be moved so that they are juxtaposed one over the other.

6. Packaging as in claim 1 in which a crenelated structure is formed in the sheet of material to provide support on opposite sides of the bottle receiving recess extending longitudinally of the bottle receiving recess.

7. Packaging as in claim 6 wherein said crenelated structure extends across opposite ends of the shell.

8. Packaging as in claim 6 wherein said first and second parts each have first and second juxtaposed bottle receiving recesses formed therein.

9. Packaging as in claim 7 wherein said crenelated structure extends between the first and second juxtaposed bottle receiving recesses.

10. Packaging as in claim 6 wherein said crenelated structure is formed by a first set of planar mating surfaces lying in a single plane and a second set of planar mating surfaces lying in a second plane spaced from the first plane with the first set and second set of mating surfaces being interconnected by adjoining sloping surfaces, said first and second sets of mating planar surfaces on the first and second parts being formed so that they are complementary to each other with the first part being mated to the second part.

11. Packaging as in claim 1 wherein said shell has first and second bottle receiving recesses in each part.

12. Packaging as in claim 11 including additional shells within the carton.

13. Packaging as in claim 12 wherein two of the shells are stacked within the case to provide packaging for four bottles.

14. Packaging as in claim 12 wherein three of the shells are stacked within the case to provide packaging for six bottles.

15. Packaging as in claim 12 wherein six of the shells are stacked in three layers of two shells each within the case to provide packaging for twelve bottles.

16. Packaging as in claim 3 wherein said supports include first and second transversely extending supports and first and second longitudinally extending supports on each of the first and second parts for each of the bottle receiving recesses therein.

17. A shell for use in packaging of bottles in a case, the bottles having a cylindrical base portion, a narrowed neck portion and an intermediate cylindrical portion between the cylindrical base portion and the narrowed neck portion and carrying a label subject to scuffing, comprising first and second parts formed of a nonplastic material in sheet form, each of said first and second parts having at least one bottle receiving recess therein, said recess having a first base support portion and a second neck support portion, said first and second parts being movable with respect to each other so that the bottle receiving recesses of the first and second parts can accommodate a bottle therein and provide support for the bottle, said recess also having an intermediate portion intermediate the first base support portion and the second neck support portion which has a diameter greater than that of the first base support portion and of the second neck support portion whereby the label of the bottle is retained out of contact with the shell to prevent scuffing of the label during shipment of the shell with the bottle therein.

18. A shell as in claim 17 wherein the first and second parts are formed of a sheet material having a fold line therein so that the second part can be swung over and into engagement with the first part to mate with the first part and to enclose a bottle in the bottle receiving recesses of the first and second parts.

19. A shell as in claim 17 wherein support structures are formed from the sheet material of the first and second parts and define surfaces which lie in spaced apart parallel planes and are adapted to engage the side walls of the case in which it is to be placed.

20. A shell as in claim 19 wherein said support structures are in the form of truncated pyramids.

21. Packaging as in claim 1 wherein said first and second semi-cylindrical portions are sized to accommodate hock, claret, burgundy and port bottles as well as champagne bottles while retaining a space between the label of the bottle and the shell to prevent scuffing of the label during shipment.

22. A shell as in claim 17 wherein the recess provided in the first and second parts can accommodate hock, claret, burgundy, port as well as champagne bottles while retaining a recess around the label of the bottle to prevent scuffing of the label during shipment of the shell with the bottle therein.

* * * * *